US006787719B2

(12) United States Patent
Wong

(10) Patent No.: US 6,787,719 B2
(45) Date of Patent: Sep. 7, 2004

(54) SWITCH AND METHOD FOR PRODUCING THE SAME

(75) Inventor: Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 33 days.

(21) Appl. No.: 10/317,963

(22) Filed: Dec. 12, 2002

(65) Prior Publication Data

US 2004/0112729 A1 Jun. 17, 2004

(51) Int. Cl.[7] ..... H01H 29/00
(52) U.S. Cl. ..... 200/182; 200/193
(58) Field of Search ..... 200/182, 185, 200/188, 193, 214, 233, 221; 219/209, 210, 528, 543, 549; 310/328, 363, 365

(56) References Cited

U.S. PATENT DOCUMENTS 6,323,447 B1 * 11/2001 Kondoh et al. ..... 200/182
6,373,356 B1 4/2002 Gutierrez
6,512,322 B1 1/2003 Wong
6,515,404 B1 2/2003 Wong
6,559,420 B1 * 5/2003 Zarev ..... 219/209

FOREIGN PATENT DOCUMENTS

JP SHO 36-18575 10/1961
JP SHO 47-21645 10/1972
JP 9161640 A 6/1997

* cited by examiner

*Primary Examiner*—Michael Friedhofer
*Assistant Examiner*—Lisa Klaus

(57) ABSTRACT

A switch and method for producing the same. In one embodiment, the switch is produced by depositing a liquid switching element on a substrate, the volume of the liquid switching element being more than needed to fulfill a switching function. A channel plate is moved toward the substrate, the channel plate having a main channel with at least one reservoir fluidically connected thereto, an excess portion of the liquid switching element flowing into the least one reservoir. The channel plate is closed against the substrate.

11 Claims, 4 Drawing Sheets

SWITCH AND METHOD FOR PRODUCING THE SAME

BACKGROUND

Liquid metal micro-switches (LIMMS) have been developed to provide reliable switching capability using compact hardware (e.g., on the order of microns). The small size of LIMMS make them ideal for use in hybrid circuits and other applications where smaller sizes are desirable. Besides their smaller size, advantages of LIMMS over more conventional switching technologies include reliability, the elimination of mechanical fatigue, lower contact resistance, and the ability to switch relatively high power (e.g., about 100 milli-Watts) without overheating, to name just a few.

According to one design, LIMMS have a main channel partially filled with a liquid metal. The liquid metal may serve as the conductive switching element. Drive elements provided adjacent the main channel move the liquid metal through the main channel, actuating the switching function.

During assembly, the volume of liquid metal must be accurately measured and delivered into the main channel. Failure to accurately measure and/or deliver the proper volume of liquid metal into the main channel could cause the LIMM to fail or malfunction. For example, too much liquid metal in the main channel could cause a short. Not enough liquid metal in the main channel may prevent the switch from making a good connection.

The compact size of LIMMS makes it especially difficult to accurately measure and deliver the liquid metal into the main channel. Even variations in the tolerance of the machinery used to deliver the liquid metal may introduce error during the delivery process. Variations in the dimensions of the main channel itself may also introduce volumetric error.

SUMMARY OF THE INVENTION

An embodiment of the invention is a switch comprising a channel plate having a main channel formed therein and at least one reservoir fluidically connected to the main channel. The switch may also comprise a substrate having at least one contact pad. A liquid switching element is deposited on the at least one contact pad, a portion of the liquid switching element flowing from the main channel into the at least one reservoir when the channel plate is assembled to the substrate.

Another embodiment of the invention is a method for assembling a switch, comprising the steps of: depositing a liquid switching element on a substrate; positioning a channel plate adjacent the substrate; and moving the channel plate toward the substrate, wherein an excess portion of the liquid switching element flows from a main channel in the channel plate into a reservoir fluidically connected to the main channel.

Yet other embodiments are also disclosed.

DESCRIPTION OF THE DRAWINGS

Illustrative and presently preferred embodiments of the invention are shown in the drawings, in which:

FIG. 1(*b*) is a perspective view of the switch of FIG. 1(*a*), shown in a second state;

FIG. 2(*b*) is a plan view of a substrate used to produce the switch according to one embodiment of the invention;

DESCRIPTION

Figure 1A:
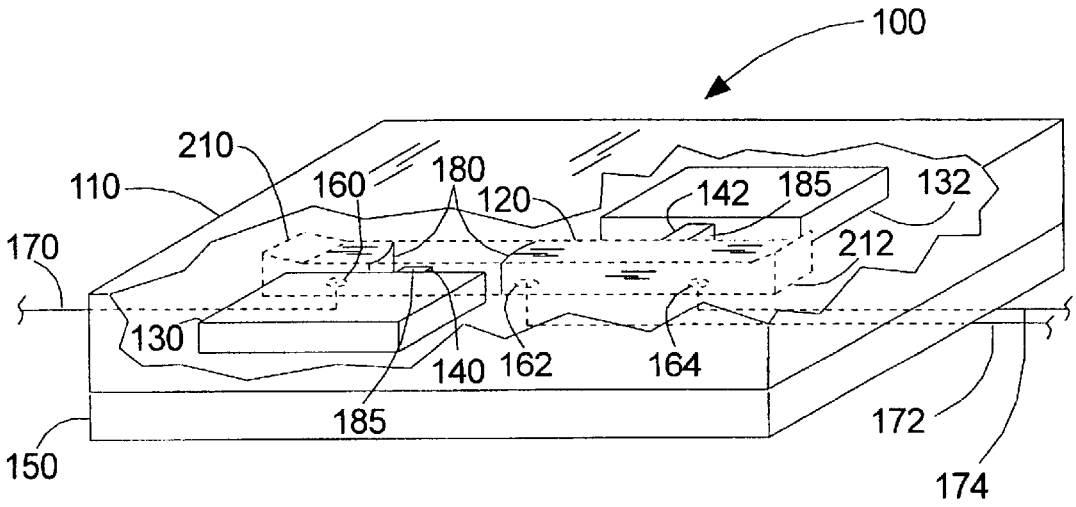
FIG. 1(*a*) is a perspective view of one embodiment of a switch, shown in a first state.
Figure 1B:
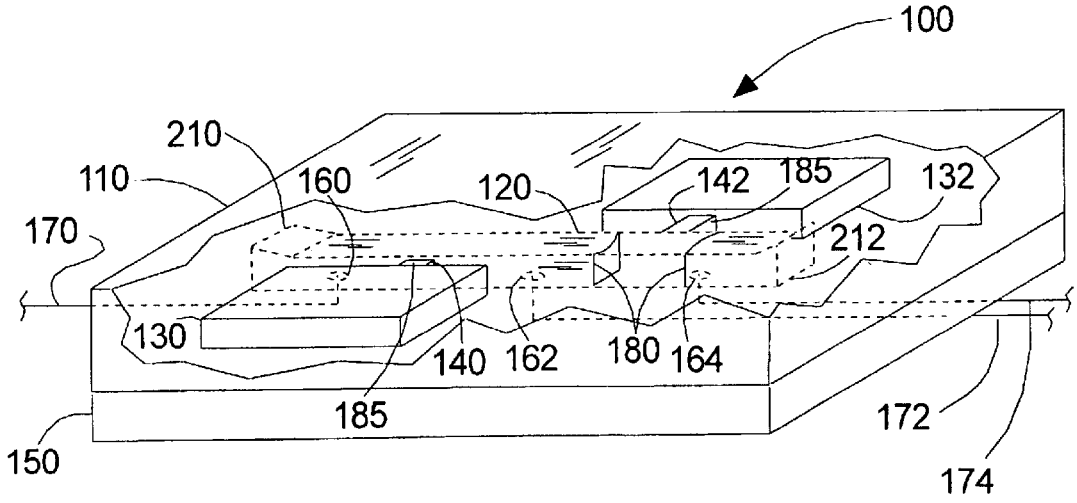

One embodiment of a switch 100 is shown and described according to the teachings of the invention with respect to FIG. 1(*a*) and FIG. 1(*b*). Switch 100 comprises a channel plate 110 defining a portion of a main channel 120, drive chambers 130, 132, and subchannels 140, 142 fluidically connecting the drive chambers 130, 132 to the main channel 120. The channel plate 110 is assembled to a substrate 150, which further defines the main channel 120, drive chambers 130, 132, and subchannels 140, 142.

In one embodiment, the channel plate 110 is manufactured from glass, although other suitable materials may also be used (e.g., ceramic, plastics, a combination of materials). The substrate 150 may be manufactured from a ceramic material, although other suitable materials may also be used.

Channels may be etched into the channel plate 110 (e.g., by sand blasting) and covered by the substrate 150, thereby defining the main channel 120, drive chambers 130, 132, and subchannels 140, 142. Other embodiments for manufacturing the channel plate 110 and substrate 150 are also contemplated as being within the scope of the invention.

Of course it is understood that the main channel 120, drive chambers 130, 132, and/or subchannels 140, 142 may be defined in any suitable manner. For example, the main channel 120, drive chambers 130, 132, and/or subchannels 140, 142 may be entirely formed within either the channel plate 110 or the substrate 150. In other embodiments, the switch may comprise additional layers, and the main channel 120, drive chambers 130, 132 and/or subchannels 140, 142 may be partially or entirely formed through these layers.

It is also understood that the switch 100 is not limited to any particular configuration. In other embodiments, any suitable number of main channels 120, drive chambers 130, 132, and/or subchannels 140, 142 may be provided and suitably linked to one another. Similarly, the main channels 120, drive chambers 130, 132, and/or subchannels 140, 142 are not limited to any particular geometry. Although according to one embodiment, the main channels 120, drive chambers 130, 132, and/or subchannels 140, 142 have a semi-elliptical cross section, in other embodiments, the cross section may be elliptical, circular, rectangular, or any other suitable geometry.

According to the embodiment shown in FIG. 1(*a*) and FIG. 1(*b*), switch 100 may also comprise a plurality of electrodes or contact pads 160, 162, 164 which are exposed to the interior of the main channel 120. Leads 170, 172, and 174 may be provided through the substrate 150 and may carry electrical current to/from the contact pads 160, 162, 164 during operation of the switch 100.

Of course the switch 100 may be provided with any number of contact pads, including more or less than shown and described herein. The number of contact pads may depend at least to some extent on the intended use of the switch 100.

In addition, the contact pads are shown and described herein as having circuit traces extending through the substrate 150. Other embodiments, however, are also contemplated as being within the scope of the invention. For example, the circuit traces may be coplanar with the contact pads. Likewise, the circuit traces may be linked to other devices by any suitable connection, such as wire-bonds, ribbon wire-bonds, solder bumps, etc.

The main channel 120 is partially filled with a liquid switching element 180. In one embodiment, the liquid switching element 180 is a conductive fluid (e.g., mercury (Hg)). As such, the liquid switching element 180 may serve as a conductive path between the contact pads 160, 162 or contact pads 162, 164. Alternatively, an opaque fluid may be used for an optical switch (not shown). The opaque fluid is used to block and unblock optical paths, as will be readily understood by one skilled in the art after having become familiar with the teachings of the invention.

The subchannels 140, 142 may be at least partially filled with a driving fluid 185. Preferably, the driving fluid 185 is a non-conductive fluid, such as an inert gas or liquid. The driving fluid 185 may be used to move the liquid switching element 180 within the main channel 120.

Figure 2A:
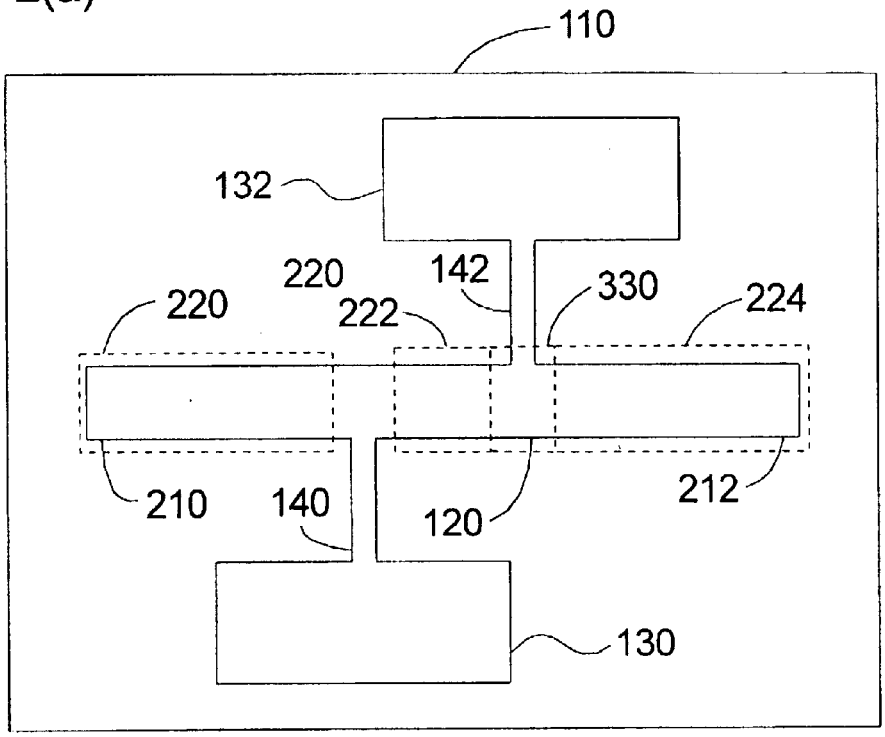
FIG. 2(*a*) is a plan view of a channel plate used to produce the switch according to one embodiment of the invention.
Figure 2B:
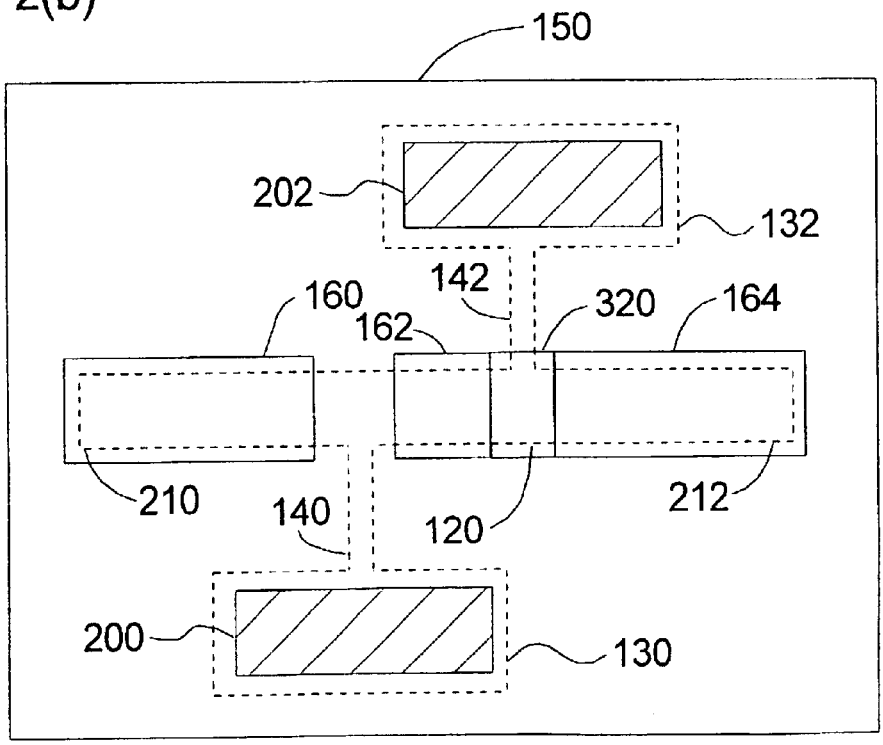

Drive elements 200, 202 (FIG. 2(*b*)) may be provided in drive chambers 130, 132. Drive elements 200, 202 may comprise, for example, heat-producing means (e.g., thin-film resistors) which heat the driving fluid 185 and cause it to expand. Other embodiments, now known or later developed, are also contemplated as being within the scope of the invention. For example, drive elements 200, 202 may comprise acoustic or pump means, to name only a few. In any event, the drive elements 200, 202 can be operated to force the driving fluid 185 into the main channel 120, causing the liquid switching element 180 to "part" and move within the main channel 120.

By way of illustration, switch 100 is shown in a first state in FIG. 1(*a*) wherein the liquid switching element 180 makes a conductive path between contact pads 162 and 164. Drive element 202 may be operated to effect a change in state of switch 100, as shown in FIG. 1(*b*). Operation of the drive element 202 causes the liquid switching element 180 to move toward the other end of the main channel 120, wherein the liquid switching element 180 makes a conductive path between contact pads 160 and 162. Similarly, drive element 200 can be operated to change the state of the switch 100 back to the first state.

Suitable modifications to switch 100 are also contemplated as being within the scope of the invention, as will become readily apparent to one skilled in the art after having become familiar with the teachings of the invention. For example, the present invention is also applicable to optical micro-switches (not shown). Also see, for example, U.S. Pat. No. 6,323,447 of Kondoh et al. entitled "Electrical Contact Breaker Switch, Integrated Electrical Contact Breaker Switch, and Electrical Contact Switching Method", and U.S. patent application Ser. No. 10/137,691 and filed on May 2, 2002 of Marvin Wong entitled "A Piezoelectrically Actuated Liquid Metal Switch", each hereby incorporated by reference for all that is disclosed.

The foregoing description of one embodiment of switch 100 is provided in order to better understand its operation. It should also be understood that the present invention is applicable to any of a wide range of other types and configurations of switches, now known or that may be developed in the future.

Switch 100 may comprise a channel plate 110 and a substrate 150, as shown in more detail according to one embodiment in FIG. 2(*a*) and FIG. 2(*b*), respectively. Note that the channel plate 110 is shown in FIG. 2(*a*) as it appears from the top, looking through the channel plate 110. Substrate 150 is shown in FIG. 2(*b*) as it appears from the side (e.g., top) that abuts the channel plate 110. In addition, the main channel 120, subchannels 140, 142, reservoirs 210, 212, and heater chambers 130, 132 are outlined in FIG. 2(*b*) to indicate their presence in embodiments where at least a portion of these features are provided in the substrate 150, as discussed above.

Channel plate 110 has a main channel 120 formed therein. Reservoirs 210, 212 are fluidically connected to the main channel 120 in channel plate 110. Preferably, reservoirs 210, 212 are tapered outward from the main channel 120, providing a larger cross-sectional area on each end of the main channel 120.

Substrate 150 has contact pads 160, 162, 164. Contact pads 160, 162, 164 may be made of a wettable material. Where the contact pads 160, 162, 164 serve to make electrical connections, contact pads 160, 162, 164 are made of a conductive material, such as metal.

Contact pads 160, 162, 164 are spaced apart from one another. Preferably, subchannels 140, 142 open to the main channel 120 in the space provided between the contact pads 160, 162, 164. Such an arrangement serves to enhance separation of the liquid switching element 180 during a switching operation.

Figure 3:
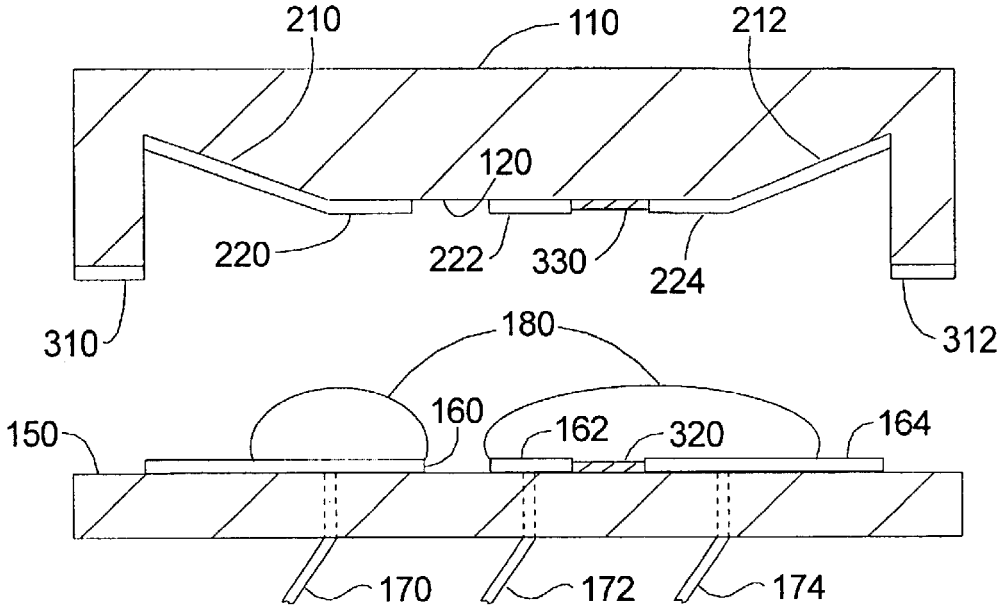
FIG. 3 is a side view of the channel plate positioned adjacent the substrate, showing a liquid switching element deposited on the substrate.

A liquid switching element 180 may be deposited on the contact pads 160, 162, 164, as shown according to one embodiment in FIG. 3. Preferably, the volume of liquid switching element 180 is more than needed to fulfill a switching function. An excess portion of the liquid switching element 180 discharges from the main channel 120 into the reservoirs 210, 212 when the channel plate 110 is assembled to the substrate 150, as will be discussed in more detail below.

It is noted that the liquid switching element 180 preferably extends between two of the adjacent contact pads (e.g., 162, 164), forming a connection therebetween. In addition, the liquid switching element 180 preferably does not extend between two of the other contact pads (e.g., 160, 162), forming a "break" in the switch 100. During operation, the liquid switching element is moved so that it forms a connection between the other two contact pads (e.g., 160, 162) and breaks the connection between the previously connected contact pads (e.g., 162, 164).

A bridge 320 may be provided between at least two adjacent contact pads (e.g., 162 and 164) to facilitate extension of the liquid switching element 180 therebetween during assembly (also see FIG. 3). Accordingly, bridge 320 may be made of a wettable material, such as a metal. In addition, bridge 320 preferably is made of a dissolvable material. For example, a bridge 320 made of gold (Au) or silver (Ag) is readily soluble when it comes into contact with a mercury (Hg) liquid switching element 180. Accordingly, the bridge 320 dissolves prior to use so that the contact pads 162 and 164 are not shorted to one another during operation of the switch 100.

Figure 4:
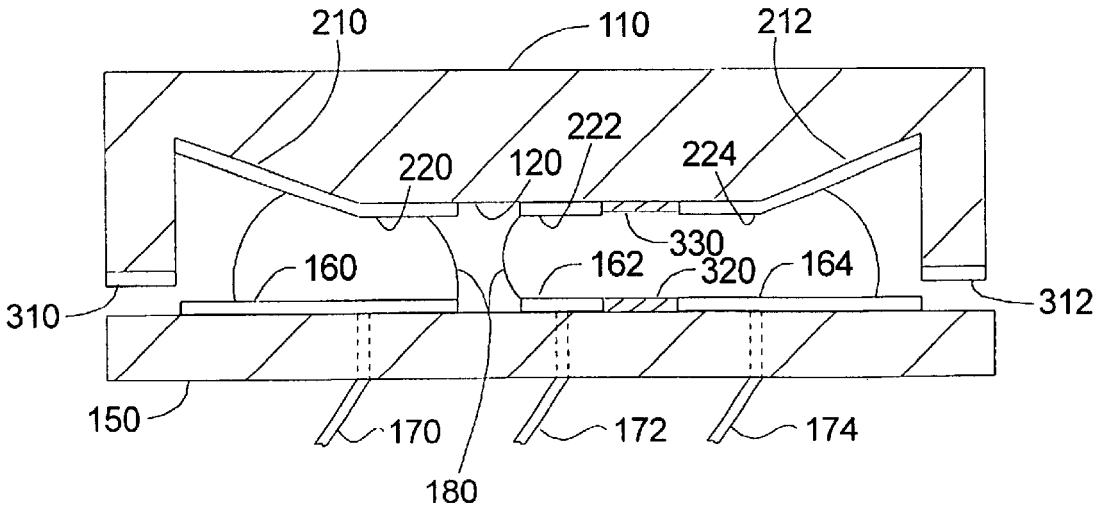
FIG. 4 is a side view of the channel plate and substrate moved toward one another, showing the liquid switching element wet to the channel plate.

Seal belts 220, 222, 224 may be provided on the channel plate 110 to promote wetting of the liquid switching element 180 to the channel plate 110 (also see FIG. 4). Seal belts 220, 222, 224 are illustrated in FIG. 2(*a*) in outline form to better show their position relative to main channel 120 and reservoirs 210, 212 (i.e., overlaying the channels).

Seal belts 220, 222, 224 are preferably made of a wettable material. Suitable materials may include metal and metal alloys, to name only a few. In one embodiment, seal belts 220, 222, 224 are made of one or more layers of thin-film metal. For example, the seal belts 220, 222, 224 may comprise a thin layer (e.g., about 1000 Å) of chromium (Cr), a thin layer (e.g., about 5000 Å) of platinum (Pt), and a thin layer (e.g., about 1000 Å) of gold (Au). The outermost layer of gold quickly dissolves when it comes into contact with a mercury (Hg) liquid switching element 180, and the mercury forms an alloy with the layer of platinum. Accordingly the liquid switching element 180 readily wets to the seal belts 220, 222, 224.

A bridge 330 may be provided between at least two adjacent seal belts (e.g., 222, 224), preferably corresponding to the bridge 320 between adjacent contact pads (e.g., 162 and 164). Again, bridge 330 is preferably made of a wettable, dissolvable material, such as gold (Au) or silver (Ag). Accordingly, bridge 330 facilitates extension of the liquid switching element 180 between the seal belts (e.g., 222, 224) during assembly, and dissolves prior to operation of the switch 100.

It is noted that the outer seal belts 220, 224 preferably extend into the adjacent reservoirs 210, 212. Such an embodiment promotes wetting of the liquid switching element 180 to the channel plate 110 and ready discharge of excess liquid switching element 180 into the reservoirs 210, 212 during assembly (see FIG. 4 and FIG. 5).

Figure 6:
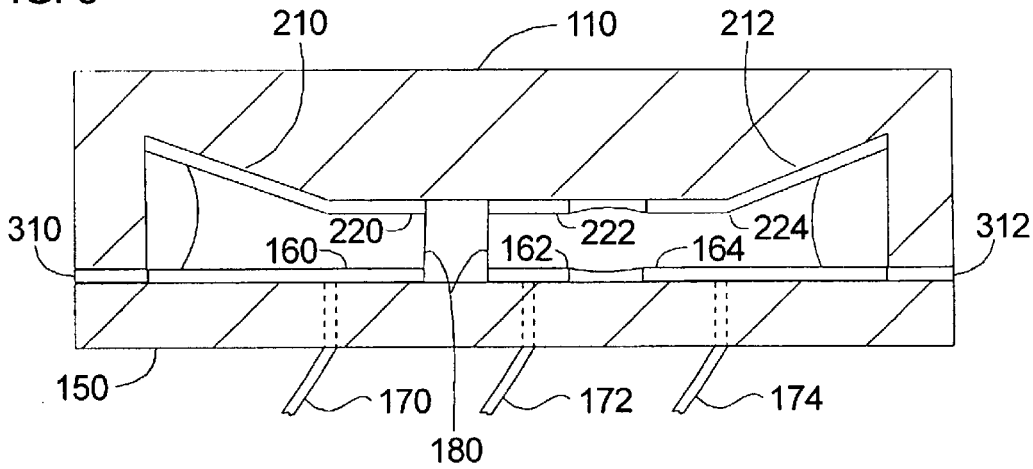
FIG. 6 is a side view of the channel plate assembled to the substrate, shown in a first state.
Figure 7:
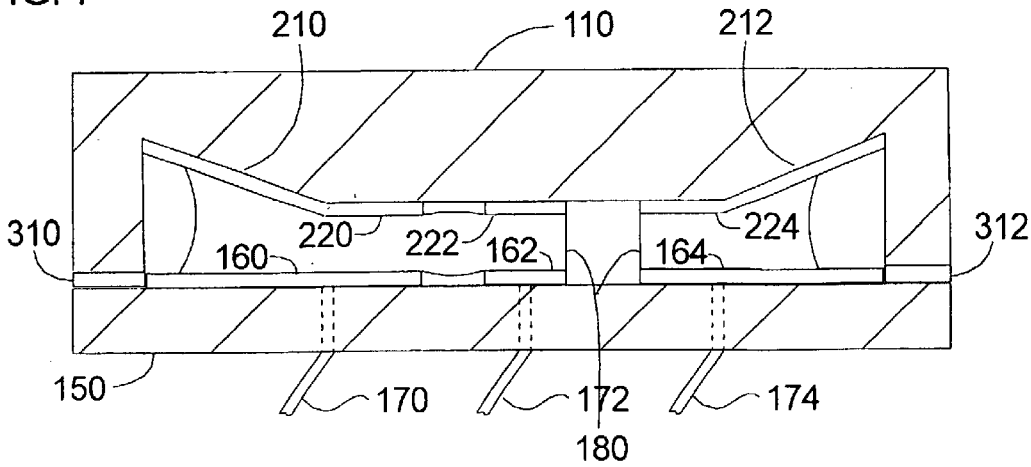
FIG. 7 is another side view of the channel plate assembled to the substrate, shown in a second state.

Following assembly, the desired amount of liquid switching element 180 remains in the main channel 120 as shown in FIG. 6 and FIG. 7. The liquid switching element 180 remaining in the main channel 120 can be used to effect a change of state in the switch 100, as described above. Excess of the liquid switching element 180 is removed from the main channel 120 in the reservoirs 210, 212. In addition, a break (e.g., gas-filled) is formed between at least two adjacent contact pads (e.g., 160 and 162).

The outer perimeter of the switch 100 may be bonded or sealed (see FIG. 6 and FIG. 7). For example, seals 310, 312 made of CYTOP® (commercially available from Asahi Glass Company, Ltd (Tokyo, Japan)) may be provided on the outer perimeter of the channel plate 110 and/or substrate 150.

Bonding the channel plate 110 to the substrate 150 preferably also serves to lock in a gas volume in the reservoirs 210, 212. Although temperature variations may change the pressure of the gas volume trapped in the reservoirs 210, 212, these variations are small and are compensated for by similar environmental pressure variations in the drive chambers 130, 132 and subchannels 140, 142. In addition, filling the reservoirs with liquid switching element 180 may cause undesirable capacitance effects. The gas volume trapped in the reservoirs 210, 212 serve to minimize capacitance effects and maintain the high frequency switching capabilities of the switch 100.

Switch 100 may be produced according to one embodiment of the invention as follows. Liquid switching element 180 is deposited on the substrate 150, as illustrated in FIG. 3. In one embodiment, liquid switching element 180 is deposited on each of the contact pads 160, 162, 164. Although liquid switching element 180 need not be accurately measured, suitable volumes of deposited liquid switching element 180 may form "swells" on the contact pads 160, 162, 164, but preferably does not run over the sides of the contact pads 160, 162, 164 onto the substrate 150. Liquid switching element 180 also wets to bridge 320, 330 between adjacent contact pads 162 and 164 and seal belts 222, 224, respectively.

The channel plate 110 may be positioned adjacent the substrate 150 (FIG. 3). Although channel plate 110 may be positioned adjacent the substrate 150 prior to depositing the liquid switching element 180, the invention is not limited to this sequence. The channel plate 110 may then be moved toward the substrate 150.

As the channel plate 110 is moved toward substrate 150 (FIG. 4), the liquid switching element 180 on contact pads 160, 164 comes into contact with and wets to the seal belts 220, 222, 224. Liquid switching element 180 also wets to bridge 330 between adjacent seal belts 222 and 224.

The hydrostatic pressure of the liquid switching element 180 increases as the channel plate 110 is moved against it, forcing excess liquid switching element 180 to be discharged into the reservoirs 210, 212 (FIG. 4). The surface tension of the liquid switching element 180 causes the liquid switching element 180 to tend to reside in areas having a smaller cross-sectional areas (i.e., the main channel 120 and the smaller cross sectional regions of the reservoirs 210, 212). Movement of the liquid switching element 180 is enhanced by wettable areas (i.e., the contact pads 160, 164 and seal belts 220, 224) extending into reservoirs 210, 212.

Figure 5:
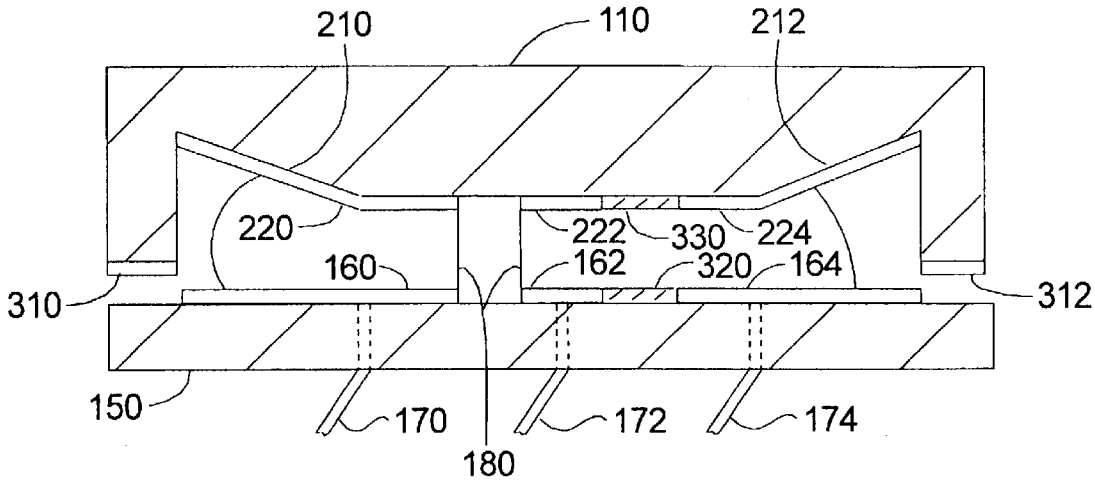
FIG. 5 is a side view of the channel plate and substrate moved closer to one another, showing the liquid switching element in equilibrium.

Preferably, the assembly process comprises pausing or slowing movement of the channel plate 110 toward the substrate 150 for a time sufficient to allow liquid switching element 180 to equilibrate. The liquid switching element 180 is shown in FIG. 5 according to one embodiment in equilibrium. According to this embodiment, the liquid switching element 180 on contact pad 160 extends substantially perpendicular to the substrate 150 and is aligned between the edge of contact pad 160 and the edge of seal belt 220. Excess liquid switching element is removed into reservoir 210.

The channel plate 110 may then be closed against the substrate 150, as shown in FIG. 6. Excess liquid switching element 180 is forced into the reservoirs 210, 212, and may "bulge" slightly inward within the main channel 120. However, the liquid switching element 180 is not forced back into the main channel 120 to the extent that the switch 100 is shorted.

The channel plate 110 may be connected to the substrate 150 in any suitable manner. In one embodiment, an adhesive is used to connect the channel plate 110 to the substrate 150. In another embodiment, screws or other suitable fasteners may be used. Preferably, the channel plate 110 is also sealed to the substrate 150 about the perimeter, as discussed above (e.g., using Cytop®). The bridges 320, 330 preferably dissolve and the liquid switching element 180 extending between adjacent contact pads 162 and 164 may "pull away" slightly from the channel plate 110 and substrate 150 between the contact pads 162, 164 and seal belts 222, 224 (FIG. 6).

The switch 100 may be operated as described above. By way of brief illustration, switch 100 is shown in a first state in FIG. 6 wherein the liquid switching element 180 makes a conductive path between contact pads 162 and 164. Drive element 202 (FIG. 2(*b*)) may be operated to effect a change in state of switch 100, as discussed above. Operation of the drive element 202 causes the liquid switching element 180 to move toward the other end of the main channel 120, wherein the liquid switching element 180 makes a conductive path between contact pads 160 and 162, as shown in FIG. 7. Drive element 200 (FIG. 2(*b*)) can be operated to change the state of the switch 100 back to the first state (FIG. 6).

It is readily apparent that switch 100 and production thereof according to the teachings of the present invention represents an important development in the field. The present invention allows for variance in the volume of liquid switching element 180 that is measured and delivered into the main channel 120. Excess liquid switching element 180 is removed into the reservoir(s) 210, 212. Accordingly, the present invention corrects for volumetric errors that may be introduced during assembly of compact switching devices (e.g., LIMMS). For example, the present invention corrects volumetric errors resulting from the tolerance of the delivery tools. The present invention also corrects for volumetric errors resulting from variations in the dimensions of the main channel 120 itself. There is no need for additional assembly tooling and the method is fast and easy to use, lowering production costs and increasing production yield.

Having herein set forth preferred embodiments of the present invention, it is anticipated that suitable modifications can be made thereto which will nonetheless remain within the scope of the present invention.

What is claimed is:

1. A switch, comprising:

a channel plate having a main channel formed therein and at least one reservoir fluidically connected to the main channel;

a substrate having at least one contact pad;

a liquid switching element deposited on said at least one contact pad, a portion of said liquid switching element flowing from the main channel into the at least one reservoir when said channel plate is assembled to said substrate.

2. The switch of claim 1, further comprising a gas volume in said at least one reservoir.

3. The switch of claim 1, wherein said at least one reservoir is tapered outward from the main channel.

4. The switch of claim 1, further comprising a bridge extending between adjacent contact pads on said substrate, said bridge receiving said liquid switching element between said adjacent contact pads.

5. The switch of claim 4, wherein said bridge is dissolvable.

6. The switch of claim 1, further comprising:

a plurality of seal belts on said channel plate; and a bridge extending between at least two adjacent seal belts on said channel plate, wherein said liquid switching element wets to said plurality of seal belts and said bridge.

7. The switch of claim 6, wherein said bridge is dissolvable.

8. The switch of claim 6, wherein at least one of said plurality of seal belts extends from the main channel into the at least one reservoir.

9. The switch of claim 1, wherein said channel plate further comprises a drive chamber connected to the main channel.

10. The switch of claim 1, further comprising a first reservoir on one end of the main channel and a second reservoir on another end of the main channel.

11. The switch of claim 1, wherein said liquid switching element is a liquid metal.

* * * * *